US005845567A

United States Patent [19]

Fischer

[11] Patent Number: 5,845,567

[45] Date of Patent: Dec. 8, 1998

[54] MANUAL TRASH COMPACTOR

[76] Inventor: Edmund Fischer, 20 Bournemouth Avenue, Kitchener, Ontario, Canada, N2B 1M7

[21] Appl. No.: 7,417

[22] Filed: Jan. 15, 1998

[51] Int. Cl.[6] ..... B30B 9/30; B30B 1/00

[52] U.S. Cl. ..... 100/226; 100/255; 100/265; 220/578; 220/908

[58] Field of Search ..... 100/226–228, 100/229 A, 240, 245, 255, 265; 220/329, 331, 578, 908

[56] References Cited

U.S. PATENT DOCUMENTS

| | | | |
|---|---|---|---|
| 468,463 | 2/1892 | Ludwig | 100/227 |
| 653,709 | 7/1900 | Stopple | 100/265 |
| 837,733 | 12/1906 | Robinson | 100/227 |
| 1,149,025 | 8/1915 | Campbell | 100/227 |
| 1,270,620 | 6/1918 | Judd | 100/226 |
| 2,392,604 | 1/1946 | Mallory | 100/228 |
| 3,919,932 | 11/1975 | Basuino | 100/228 |
| 4,022,123 | 5/1977 | Bachmann | 100/255 |
| 4,050,373 | 9/1977 | Hellmann | 100/229 A |

FOREIGN PATENT DOCUMENTS

| | | | |
|---|---|---|---|
| 764207 | 8/1967 | Canada | 100/226 |

*Primary Examiner*—Stephen F. Gerrity

[57] ABSTRACT

A manual trash compactor is provided including a box having an open top. A hand operated compactor assembly includes a compactor with a member integrally coupled thereto and extending upwardly therefrom for gripping by a user, whereby the compactor may be manually depressed within the box for allowing the compacting of trash therein.

4 Claims, 2 Drawing Sheets

MANUAL TRASH COMPACTOR

BACKGROUND OF THE INVENTION

1. Field of the Invention

The present invention relates to mechanized compactors and more particularly pertains to a new manual trash compactor for manually compacting trash for compact storage.

2. Description of the Prior Art

The use of mechanized compactors is known in the prior art. More specifically, to mechanized compactors heretofore devised and utilized are known to consist basically of familiar, expected and obvious structural configurations, notwithstanding the myriad of designs encompassed by the crowded prior art which have been developed for the fulfillment of countless objectives and requirements.

Known prior art to mechanized compactors include U.S. Pat. No. 4,095,521; U.S. Pat. No. 04,128,055; U.S. Pat. No. 4,696,227; U.S. Pat. No. 4,638,730; U.S. Pat. No. 4,991,500; and U.S. Pat. Des. 286,883.

In these respects, the manual trash compactor according to the present invention substantially departs from the conventional concepts and designs of the prior art, and in so doing provides an apparatus primarily developed for the purpose of manually compacting trash for compact storage.

SUMMARY OF THE INVENTION

In view of the foregoing disadvantages inherent in the known types of mechanized compactors now present in the prior art, the present invention provides a new manual trash compactor construction wherein the same can be utilized for manually compacting trash for compact storage.

The general purpose of the present invention, which will be described subsequently in greater detail, is to provide a new manual trash compactor apparatus and method which has many of the advantages of the mechanized compactors mentioned heretofore and many novel features that result in a new manual trash compactor which is not anticipated, rendered obvious, suggested, or even implied by any of the prior art mechanized compactors, either alone or in any combination thereof.

To attain this, the present invention generally comprises a cubical box having a square bottom face and a side wall. The side wall comprises a rear square face and a pair of square side faces defining an interior space, an open top and an open front. The box further includes a square front door hingably coupled at a first side edge thereof to one of the side faces. The door is adapted to pivot about a vertical axis with a second side edge releasably coupled to another one of the side faces of the box. FIGS. 1 & 2 show a plunger guide including an elongated planar rectangular plate. The rectangular plate is mounted on a vertical recipient surface adjacent to and above the cubical box. A front face of the plate has a pair of guides each having an L-shaped horizontal cross-section. The guides are spaced to define a vertical slot and a rectangular front opening. Next provided is a plunger assembly including an elongated planar rectangular member having a thin rectangular strip mounted to a front face thereof. A post is coupled to the front face of the member adjacent to a top thereof and extending in perpendicular relationship with the member. The member is slidably situated within the slot of the plunger guide. The strip is slidably situated within the front opening of the plunger guide. Note FIGS. 1 & 2. Also included is a compactor assembly having a lid mount with a width equal to that of the rear face of the box. The lid mount is coupled to a bottom end of the plunger assembly in coplanar relationship therewith. A lid with a planar square configuration has a rear edge hingably coupled to a lower edge of the lid mount. Finally, a locking mechanism is provided including a protrusion coupled to a front face of the lid mount and extending outwardly therefrom. A locking clip has a first end pivotally coupled to a top face of the lid with a first orientation situated beneath the protrusion for maintaining the lid in perpendicular relationship with the lid mount. The locking clip further has a second orientation rotated away from the protrusion for allowing the lid to be pivoted upwardly to permit placement of trash within the box.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new manual trash compactor apparatus and method which has many of the advantages of the mechanized compactors mentioned heretofore and many novel features that result in a new manual trash compactor which is not anticipated, rendered obvious, suggested, or even implied by any of the prior art mechanized compactors, either alone or in any combination thereof.

It is another object of the present invention to provide a new manual trash compactor which may be easily and efficiently manufactured and marketed.

It is a further object of the present invention to provide a new manual trash compactor which is of a durable and reliable construction.

An even further object of the present invention is to provide a new manual trash compactor which is susceptible of a low cost of manufacture with regard to both materials and labor, and which accordingly is then susceptible of low prices of sale to the consuming public, thereby making such manual trash compactor economically available to the buying public.

Still yet another object of the present invention is to provide a new manual trash compactor which provides in the apparatuses and methods of the prior art some of the advantages thereof, while simultaneously overcoming some of the disadvantages normally associated therewith.

Still another object of the present invention is to provide a new manual trash compactor for manually compacting trash for compact storage.

Even still another object of the present invention is to provide a new manual trash compactor that includes a box having an open top. A hand operated compactor assembly includes a compactor with a member integrally coupled thereto and extending upwardly therefrom for gripping by a user, whereby the compactor may be manually depressed within the box for allowing the compacting of trash therein.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
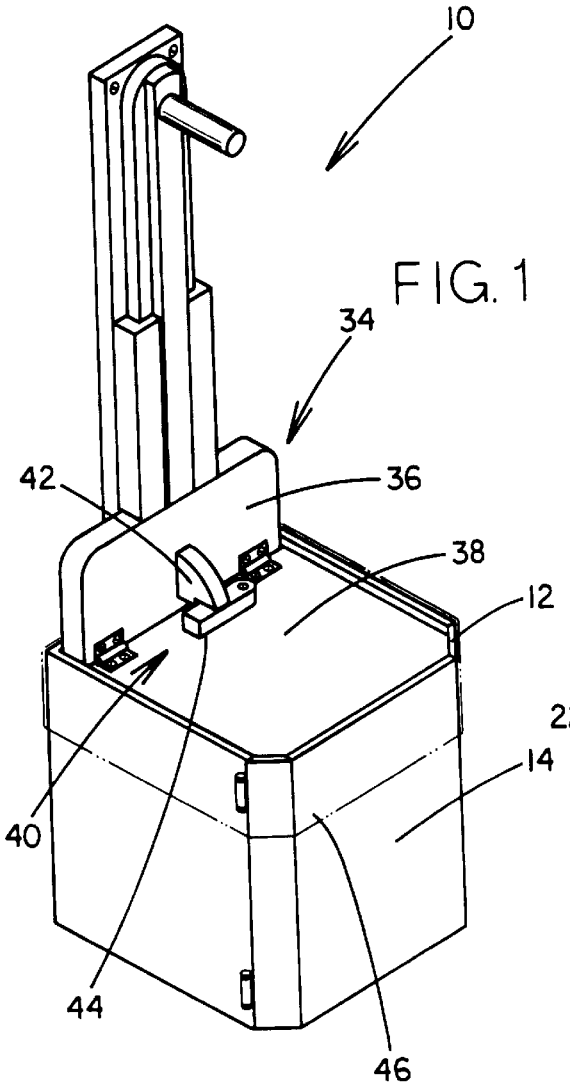
FIG. 1 is a perspective view of a new manual trash compactor according to the present invention.

With reference now to the drawings, and in particular to FIGS. 1 through 4 thereof, a new manual trash compactor embodying the principles and concepts of the present invention and generally designated by the reference numeral 10 will be described.

The present invention, designated as numeral 10, includes a cubical box 12 having a square bottom face and a side wall. The side wall comprises a rear square face and a pair of square side faces defining an interior space, an open top and an open front. The box further includes a square front door 14 hingably coupled at a first side edge thereof to one of the side faces. The door is adapted to pivot about a vertical axis with a second side edge releasably coupled to another one of the side faces of the box. In the preferred embodiment, the door has a planar central extent and a pair of beveled side extents.

Figure 2:
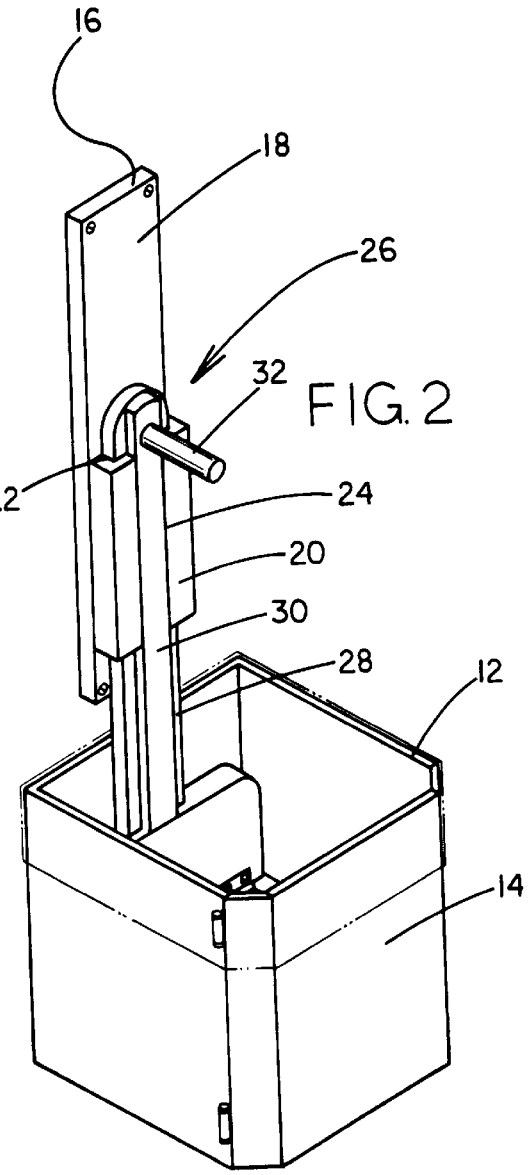
FIG. 2 is a perspective view of the present invention.
Figure 3:
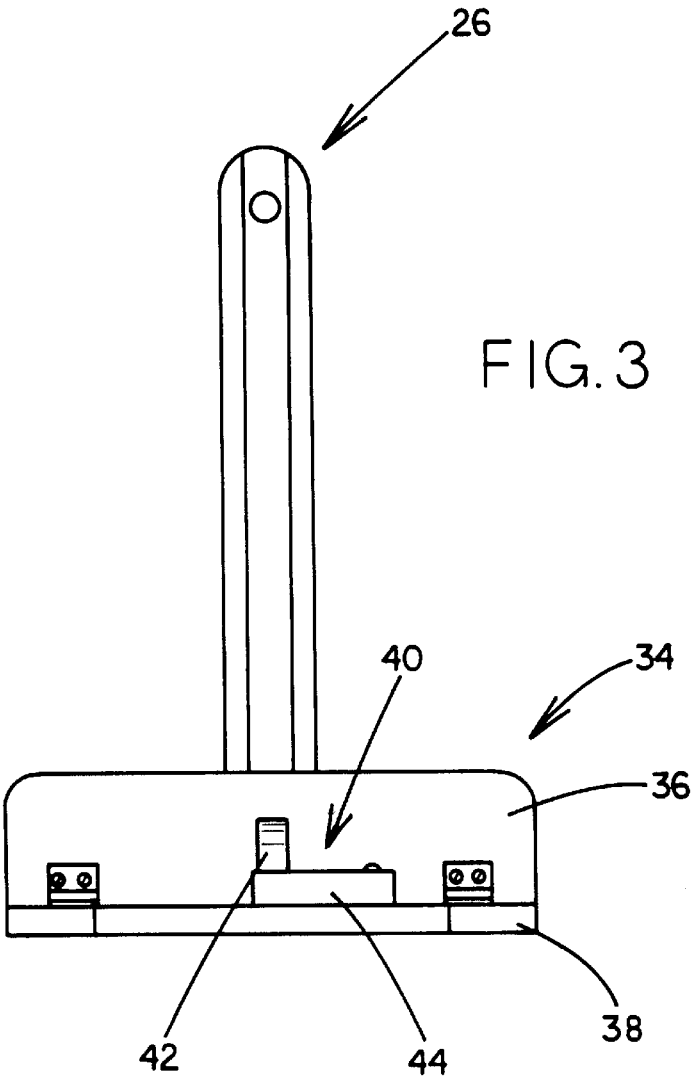
FIG. 3 is a front view of the present invention.
Figure 4:
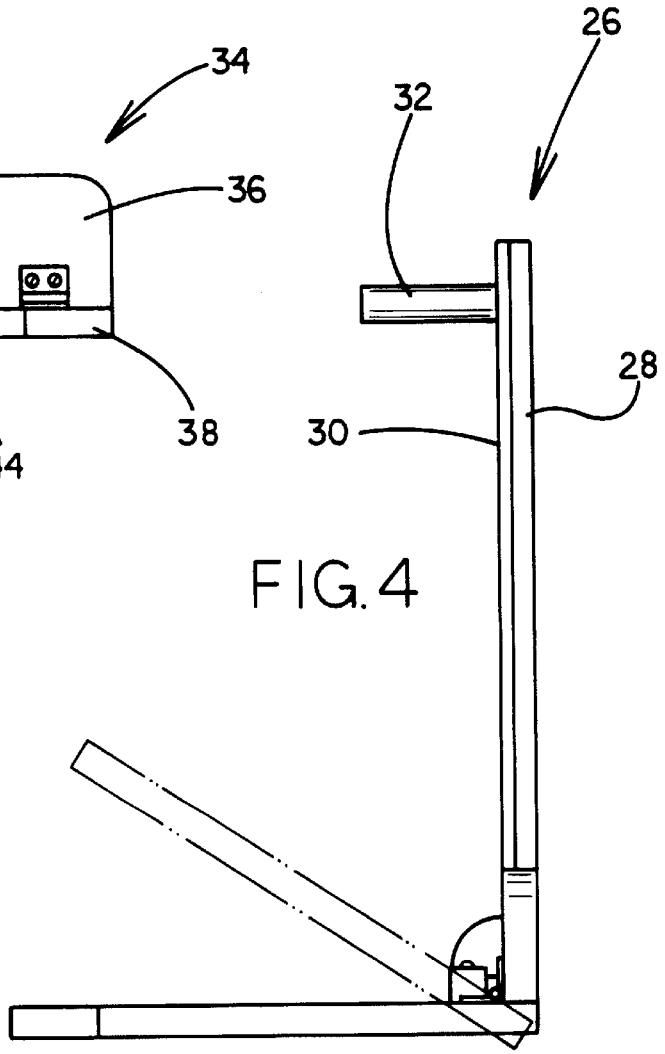
FIG. 4 is a side view of the present invention.

FIGS. 1 & 2 show a plunger guide 16 including an elongated planar rectangular plate 18. The rectangular plate is mounted on a vertical recipient surface adjacent to and above the cubical box. A front face of the plate has a pair of guides 20 each having an L-shaped horizontal cross-section. The guides are spaced to define a vertical slot 22 and a rectangular front opening 24. In the preferred embodiment, the guides each have a length of about half that of the plate 18.

Next provided is a plunger assembly 26 including an elongated planar rectangular member 28 having a thin rectangular strip 30 mounted along a central axis of a front face thereof. As shown in the Figures, the strip has a width which is half that of the member. A post 32 is coupled to the front face of the member adjacent to a top thereof and extended in perpendicular relationship with the member. The member is slidably situated within the slot of the plunger guide. Further, the strip is slidably situated within the front opening of the plunger guide. Note FIGS. 1 & 2.

Also included is a compactor assembly 34 having a lid mount 36 with a width equal to that of the rear face of the box. The lid mount is coupled to a bottom end of the plunger assembly in coplanar relationship therewith. A lid 38 with a planar square configuration has a rear edge hingably coupled to a lower edge of the lid mount. Due to the unique coupling between the lid and lid mount shown in FIG. 4, the lid is permitted to only pivot upwardly.

Finally, a locking mechanism 40 is provided including a protrusion 42 coupled to a front face of the lid mount and extended outwardly therefrom. The protrusion preferably has an arcuate top face and a planar bottom face with an outboard recess formed therein. A locking clip 44 has a first end pivotally coupled to a top face of the lid with a first orientation situated beneath the protrusion within the recess for maintaining the lid in perpendicular relationship with the lid mount. The locking clip further has a second orientation rotated away from the protrusion for allowing the lid to be pivoted upwardly to permit placement of trash within the box.

During use, the locking mechanism may be placed in the first orientation thereof and the plunger and lid may be may be lowered to compact trash within the box. It should be noted that a frictional abutment between the plunger and plunger guide maintains the plunger and compactor assembly stationary prior to use. Further, during use, a plastic bag 46 is preferably situated within the box.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A manual trash compactor comprising, in combination:

a cubical box having a square bottom face and a side wall comprising a rear square face and a pair of square side faces defining an interior space, an open top and an open front, the box further including a square front door hingably coupled at a first side edge thereof to one of the side faces and adapted to pivot about a vertical axis with a second side edge releasably coupled to another one of the side faces of the box;

a plunger guide including an elongated planar rectangular plate mounted on a vertical recipient surface adjacent to and above the cubical box, a front face of the plate having a pair of guides each having an L-shaped horizontal cross-section and spaced to define a vertical slot and a rectangular front opening;

a plunger assembly including an elongated planar rectangular member having a thin rectangular strip mounted to a front face thereof and a post coupled to the front face of the member adjacent to a top thereof and extending in perpendicular relationship with the member, whereby the member is slidably situated within the slot of the plunger guide with the strip being slidably situated within the front opening of the plunger guide;

a compactor assembly including a lid mount having a width equal to that of the rear face of the box and coupled to a bottom end of the plunger assembly in coplanar relationship therewith, a lid having a planar square configuration with a rear edge hingably coupled to a lower edge of the lid mount;

a locking mechanism including a protrusion coupled to a front face of the lid mount and extending outwardly therefrom and a locking clip having a first end pivotally coupled to a top face of the lid with a first orientation situated beneath the protrusion for maintaining the lid in perpendicular relationship with the lid mount and a second orientation rotated away from the protrusion for allowing the lid to be pivoted upwardly to permit placement of trash within the box;

whereby the locking mechanism may be placed in the first orientation thereof and plunger and lid may be may be lowered to compact trash within the box.

2. A manual trash compactor comprising:

a box having an open top;

a hand operated compactor assembly including a compactor with a member integrally coupled thereto and extending upwardly therefrom for gripping by a user, whereby the compactor may be manually depressed within the box for allowing the compacting of trash therein;

wherein the member of the compactor assembly is slidably situated within a guide mounted to a vertical recipient surface; and wherein the compactor is pivotally coupled with respect to the member for functioning as a lid prior to compacting and further included is a pivoting locking mechanism for selectively precluding the upward pivoting of the compactor with respect to the member.

3. A manual trash compactor as set forth in claim 2 wherein the box has an open front and a door pivotally coupled thereto.

4. A manual trash compactor as set forth in claim 2 wherein the member of the compactor assembly has a grip coupled to a top thereof and extended therefrom for facilitating gripping by a user.

* * * * *